US006126274A

United States Patent [19]

Kohyama

[11] Patent Number: 6,126,274

[45] **Date of Patent: *Oct. 3, 2000**

[54] IMAGE RECORDING APPARATUS HAVING AN INTERMEDIATE IMAGE RECEIVING MEANS FOR A VARIABLE ELECTRIC FIELD TO EJECT TONER PARTICLES

[75] Inventor: Mitsuaki Kohyama, Tokyo, Japan

[73] Assignee: Kabushiki Kaishia Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/866,362

[22] Filed: May 30, 1997

[30] Foreign Application Priority Data

May 31, 1996 [JP] Japan ..... 8-138395

[51] Int. Cl.[7] ..... B41J 2/06

[52] U.S. Cl. ..... 347/55

[58] Field of Search ..... 347/55, 154, 153, 347/120, 141, 103; 399/271, 290, 292, 293, 294, 295

[56] References Cited

U.S. PATENT DOCUMENTS

| | | | |
|---|---|---|---|
| 5,198,842 | 3/1993 | Fujino et al. | 347/154 |
| 5,689,295 | 11/1997 | Eremin et al. | 347/55 |

FOREIGN PATENT DOCUMENTS

| | | | |
|---|---|---|---|
| 0703080 | 3/1996 | European Pat. Off. | 347/55 |
| 62-6282 | 1/1987 | Japan . | |
| 2-181166 | 7/1990 | Japan . | |

*Primary Examiner*—John Barlow
*Assistant Examiner*—R. Y. Gordon
*Attorney, Agent, or Firm*—Anderson, Kill & Olick, P.C.

[57] ABSTRACT

This invention provides a new and improved image-forming apparatus which is of relatively easy manufacture and which provides a clear, sharp image. This apparatus is an "ink jet" printer which utilizes a liquid dispersion of toner as the image-forming material. The liquid dispersant is dielectric relative to the toner particles. The toner particles agglomerate when placed under an electric charge and these agglomerated particles are ejected in accordance with an image signal. The toner forms an image on an image holder which is transferred to a recording medium such as paper. This invention has the provision for four-color printing.

8 Claims, 9 Drawing Sheets

FIG. 4
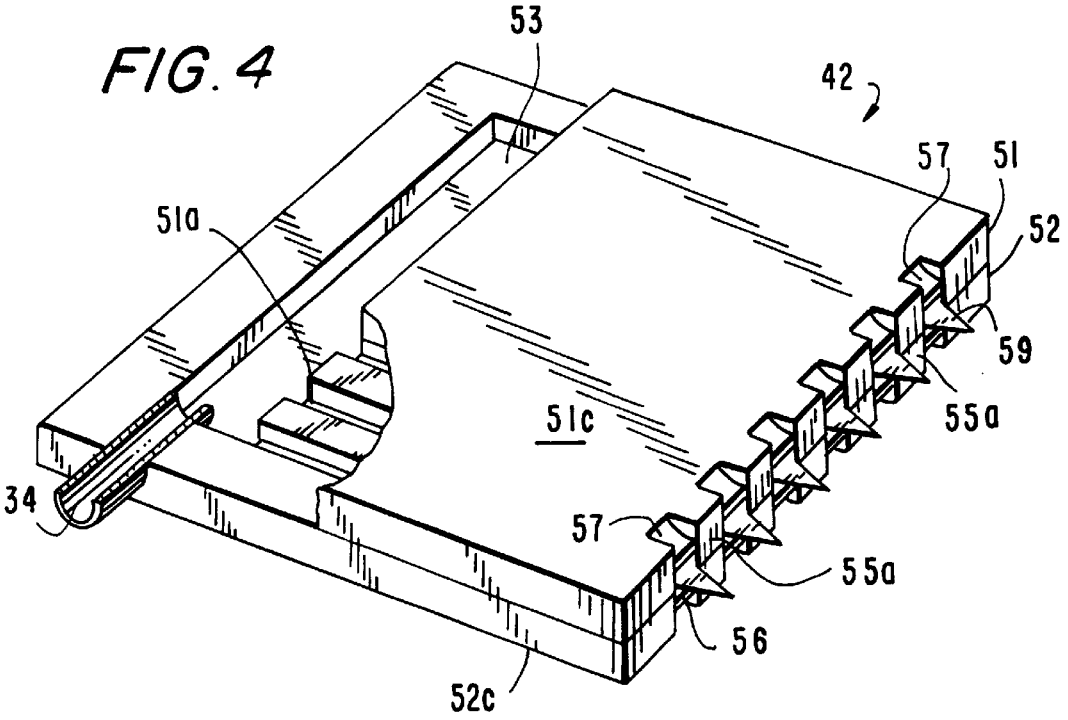
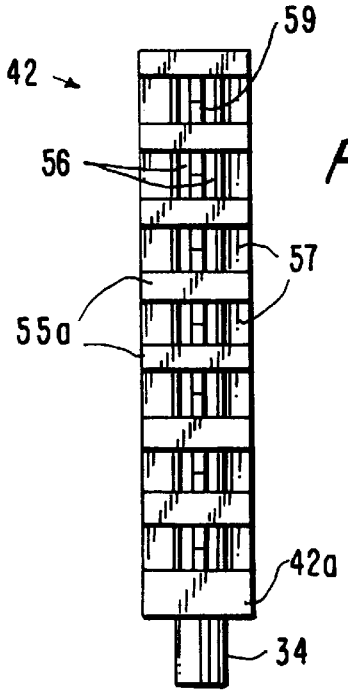
FIG. 5

FIG. 6(a)
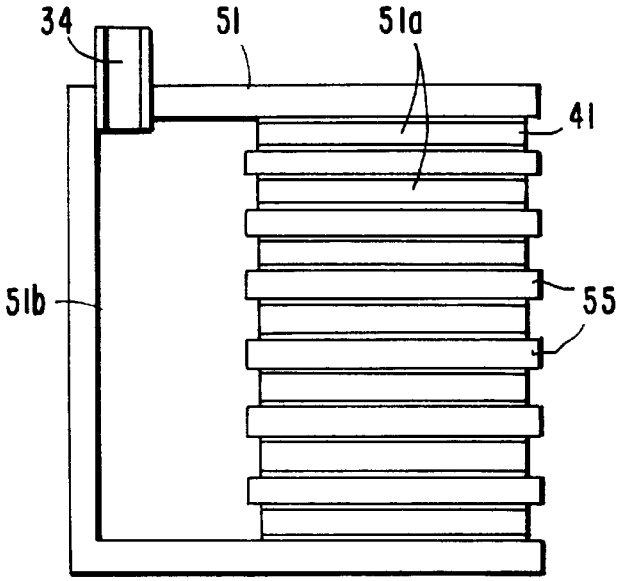
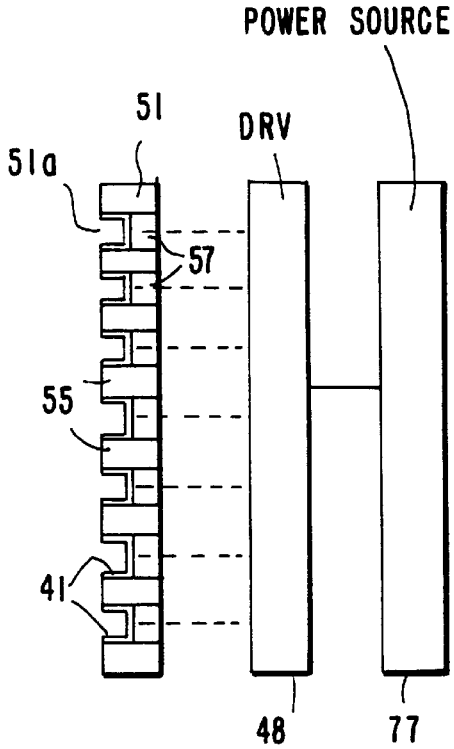
FIG. 6(b)
FIG. 7
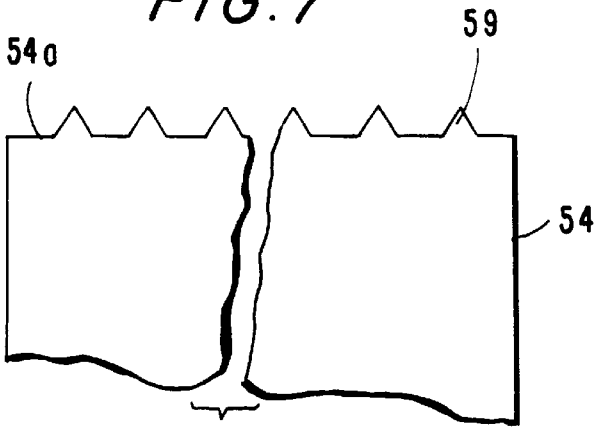

FIG. 12
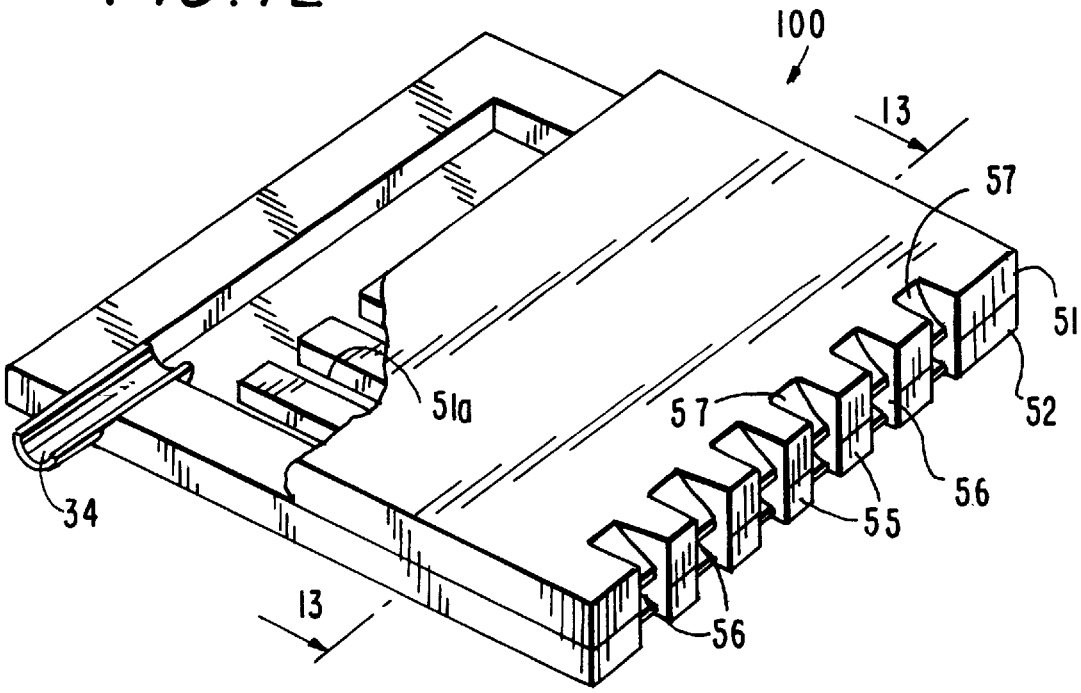
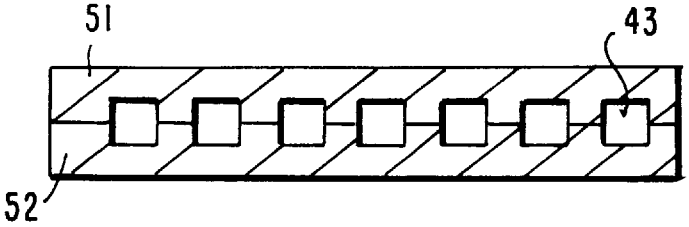
FIG. 13

IMAGE RECORDING APPARATUS HAVING AN INTERMEDIATE IMAGE RECEIVING MEANS FOR A VARIABLE ELECTRIC FIELD TO EJECT TONER PARTICLES

FIELD OF THE INVENTION

This invention relates to image-forming apparatus, such as copiers and printers in which electrostatic energy is exerted onto a liquid dispersion of a dielectric or insulating carrier liquid and a pigmented fusible resin particulate. The electrostatic energy causes the particulate to separate from the carrier and be ejected onto an image holder whereby the particulate forms a predetermined image.

BACKGROUND OF THE INVENTION

In the field of electrophotography, a toner image is first formed on a photosensitive member, transferred onto a transfer paper, and then, fixed thereon to form an image. There is a technique as disclosed in Japanese Patent Laid-Open (Kokai) H2-181166, which is hereby incorporated by reference, in which a toner image is formed on a belt-like toner image holder which is then transferred and fixed onto a sheet of paper. The belt-like image holder is held in a triangular configuration.

Such a recording technique, however, requires a dry powder toner, which complicates its handling; it also requires a relatively large device which is not suitable for a personal machine.

For these reasons, another technique has become popular in the electrophotographic field. This technique is ink jet printing. A conventional ink jet printer, which uses pigmented printing ink however, has had drawbacks of its own in poor image durability and exposure resistance.

An image-forming "jet flow" apparatus has been disclosed in an international publication No. W093/11866, which is hereby incorporated by reference, in which pigmented particles are used as the coloring material to overcome the above-mentioned drawbacks. This apparatus is equipped with a conductive supply tube; a predetermined voltage is applied onto the supply tube to form a predetermined electric field between the supply tube and the electrodes facing the end of the tube. A liquid dispersion of pigmented particles charged to the same polarity as the electrical potential of the supply tube is supplied to the tube. The pigmented particles separate from the liquid. There is a recording medium, such as paper, interposed between the end of the supply tube and the facing electrodes, which is transported in a predetermined direction.

Because of the electric field formed between the end of the supply tube and the facing electrodes, the colored particles in the liquid dispersion are electrostatically attracted by facing electrodes at the ejection point near the end of the supply tube; and a semi-spherical liquid meniscus is formed at or near the end of the supply tube. Since, however, the particles cannot flow from the liquid meniscus because of the surface tension of the liquid in the dispersion, they stay at the liquid meniscus. In this manner, many particles remain at the point of the liquid meniscus as agglomerates.

As the recording medium (paper) is transported in a predetermined direction, a higher voltage is applied to the supply tube, the electric field is established between the end of the supply tube and the facing electrode is strengthened. The electrostatic attraction force on the particulates or agglomerates becomes stronger than the surface tension of the liquid of the dispersion; and consequently, the agglomerates or particles pass through the liquid meniscus and flow toward the recording medium which is positioned between the supply tube and a facing electrode. A predetermined image is formed on the recording medium with agglomerates of colored particles from the supply tube, having been freed from the liquid meniscus.

Since the image-forming apparatus configured based on the above "jet flow" theory does not use a nozzle which establishes droplet size in a conventional ink jet printing, pigmented particles can be used. Therefore, problems, such as image durability and exposure resistance, of conventional ink jet printers can be resolved.

Furthermore, in a conventional jet flow image-forming apparatus, a recording medium (such as paper) is transported between the end of the supply tube and the facing electrodes. It is therefore necessary to provide a predetermined gap therebetween to allow the recording medium to pass through smoothly. An insufficient gap may cause poor image formation due to contact with the recording medium.

Consequently, since such a predetermined gap needs to be provided between the end of the supply tube and the facing electrodes in a conventional image-forming apparatus, a relatively high voltage must be applied to the supply tube in order to form an electric field strong enough to transport the particle agglomerates. The high voltage which the supply tube requires makes the integration of the drive circuit for the supply tube difficult, the configuration remains complex, and consequently increases the difficulty of manufacture and cost.

If the gap size is set according to the thickness of the recording medium to be used, a relatively thin recording medium must be used for narrowing the gap as much as possible to reduce the recording voltage required for printing; consequently, this limits the freedom of selection of the recording medium.

On the other hand, if the gap size is made constant and printing paper of different thickness and different electric resistance is used, even if a predetermined voltage is applied to the supply tube, the magnitude of the electric field formed between the end of the tube and the facing electrodes can vary, preventing stable image formation.

SUMMARY OF THE INVENTION

The present invention provides an image-forming apparatus in which a wide variety of recording media can be used, a clear images are formed, and lends itself to relatively easy manufacture.

To achieve the above objective, the image-forming apparatus of this invention comprises:

electrodes having tips distanced from an image holder at a predetermined interval; a supply means which supplies a liquid dispersion of particulates to the tips of the electrodes, the dispersion "ink" being made by dispersing charged colored particles into an insulating carrier liquid; an image-forming means in which, by applying voltage to the electrodes according to a specific image signal, the colored particles in the liquid dispersion are agglomerated near the tips, and the agglomerated particles are separated and ejected from the insulating carrier liquid to form an image on an image holder; a transport means for transporting a recording medium toward the image holder; and a transfer means for transferring the image formed on the image holder onto the recording medium which has been transported by the transport means.

DETAILED DESCRIPTION OF THE INVENTION

The image-forming apparatus of this invention comprises: an image holder driven in a predetermined direction; electrodes having tips distanced from the image holder surface at predetermined intervals; a supply means which supplies dispersion of particulates to the tips of the electrodes, the dispersion being made by dispersing charged colored particles into a dielectric carrier liquid; an image-forming means in which, by applying a voltage to the electrodes according to a specific image signal, a predetermined electric field is formed directed from the tips of the electrode to the image holder, a predetermined electrostatic force exerted to the particle agglomerates at or near the end of the supply means, the agglomerated particles are separated and ejected from the insulating carrier liquid to flow to said image holder, to form a predetermined image on the surface of the image holder; a transport means which transports a recording medium to a transfer location adjacent to the image holder, synchronized with the image formed on the image holder by the image-forming means and transported in a predetermined direction as the image holder is driven; and a transfer means for transferring the image formed on the image holder onto the recording medium which has been transported to the transfer location by the transport means.

In the image-forming apparatus of this invention, the particles in the dispersion supplied to the tips of the electrodes are ejected to the image holder surface to form a predetermined image thereon. The image is carried to a predetermined transfer location together with the driving of the image holder, then transferred onto the synchronously transported recording medium. In other words, according to the image-forming apparatus of this invention, the image is temporarily held on the image holder, and carried to the transfer location to be transferred onto the recording medium.

In addition to the advantages of this invention set forth above, it provides yet additional advantages over the prior art. For example, unlike a conventional ink jet, in this invention, the image is not formed by directly flowing colored particles onto a recording medium. Accordingly, it is not necessary to interpose a recording medium between the tips of the electrodes and the image holder to which particles flow, thus allowing the gap to be narrowed greatly. This decreases the magnitude of the electric field required to flow the colored particles, greatly lowers the recording voltage required for printing, and allows advanced integration of the driving circuit for applying the recording voltage; this simplifies the configuration and reduces manufacturing cost.

Furthermore, in addition, this invention eliminates the need for a recording medium to be transported between the electrode tips and the image holder, thus providing a variety of choice in a recording medium. This makes it possible to form a stable electric field therebetween and, therefore, a stable image.

The image holder is preferably a metallic belt coated with a suitable, abrasion-resistant, heat-resistant material which readily separates from the image-forming particulates. Illustrative of suitable materials are silicone resins, silicone rubbers, fluoroplastics, or polyimide resins. It is contemplated to use a non-metallic belt as well metallic. In this instance, the belt is made with materials similar to those used as coatings above. These non-metallic belts can be reinforced with various materials such as scrim or fiberglass. If non-metallic belts are used, a spreading plate may be necessary. Metallic belts are preferred.

The liquid dispersion of pigmented particulate, hereinafter referred to as toner, is made by dispersing the toner in an insulating or dielectric carrier fluid. The charged toner is used in an amount of from about 2 to about 10 percent by weight.

The carrier liquid is a dispersive medium having a resistivity of at least $10^9$ Ωcm. It is preferred that the carrier liquid have resistivity of from about $10^{11}$ Ωcm to about $10^{13}$ Ωcm.

Suitable carrier liquids include isoparaffins such as Isoper G, H, K, L, and M (Esso Sekiyu), silicone oils, hexane, pentane, octane, or the like. The resistivity of the carrier fluid is conveniently measured by using a precision LCR meter 4284A manufactured by Hewlett-Packard using a measurement head of liquid test fixture 16452A.

The toner has a particle diameter of from about 0.01 to about 5 μm. In composition the toner is a thermoplastic resin particle which contains pigments or colorants, and ingredients such as metallic soaps are added for charging to a predetermined electrical potential in the carrier. For example, for a positive electropotential, zirconium octylate, lithium octylate, and the like can be useful.

Although the liquid-dispersed toner is similar to a liquid developer used in electrophotography, it is necessary to use one having a higher resistivity than that of a liquid developer. That is to say, if the resistivity of the carrier liquid is low, the electric field will not attract the charged toner, causing a serious condition—toner separation failure. Also, if the resistivity of the toner is low, the carrier itself gets conducted like a conventional ink jet of electrostatic technique, charging the entire dispersion. Consequently, the toner is not distinguished from the carrier, and this results in the ejection of all of the dispersion, losing the effect and benefit of this invention. For this reason, the carrier liquid has to have higher resistivity.

A factor which undesirably decreases the resistivity in a toner dispersion may be the addition of a metallic soap, such as zirconium naphthenate or octylate, or various other surfactants. Consequently, such additives should be used in as small amounts as possible.

The resistivity of the toner, with which excellent recording properties can be obtained when it is used, for example, with the recording apparatus 10 of this embodiment, is $10^8$ Ω·cm or more ("excellent" properties mean the condition under which only toner is mainly separated from the carrier fluid and ejected). With this magnitude of resistivity, the fluidity or blurred condition is reduced on a normal printing paper P; with the toner resistivity of $10^{10}$ Ω·cm or more, the sharpness in delineation of image is further improved. It is understood from these that it is desirable for the resistivity of the toner to be as high as possible.

To obtain such a high resistivity in the toner, the resistivity in the carrier liquid prior to dispersing toner needs to be much higher than that of the toner. Taking account of the effects of the above-mentioned additives, the resistivity of the carrier liquid needs to be $10^{10}$ Ω·cm or more, but always much higher than that of the toner. A necessary minimum amount of the above-mentioned additives is added to disperse the toner into the carrier liquid having such an effect to reduce the resistivity of the carrier liquid to about $10^8$ Ω·cm. "Necessary minimum amount" means that "necessary amount" for maintaining the level without practical problems from the standpoint of toner electrification, dispersion stability, and the like; the specific value varies according to the material used. Therefore, the higher the resistivity of the carrier liquid (origin) is, the more freedom there is for the use of dispersion-helping agents or charge-regulating agents during the preparation of the toner.

Although the components of the toner dispersion are basically the same as a liquid developer used in electrophotography, the resistivity of the carrier needs to be much higher. Accordingly, it is necessary to reduce the conductive components in the toner dispersion to meet the objective of this invention.

The toner used in this invention, which is suitable to make a toner of high resistivity, may be made in the following way: resin, dyes, or pigments and a charge-regulating agent are tempered; the tempered material is milled to a desired particle diameter after cooling to obtain fine toner particles; the fine particles are coated with a small amount of dispersion agent; a small amount of swelling solvent is added thereto if needed; and the particles are dispersed into a carrier liquid.

In a recording method of this invention (to be described later), the toner is selectively projected on the outer surface 3*a* of the belt 3 (interim image holder) to form an image thereon. Therefore, not the entire image holder (the photosensitive member) gets wet unlike a conventional electrophotography technology. Consequently, no so-called "halation" occurs in the recording method of this invention, allowing the toner density to be set higher compared to that of the dispersion used in a conventional electrophotographic technology. Accordingly, the density of the dispersion can be set, increasing the dispersion stability of the toner and making it difficult for the toner to precipitate and agglomerate.

Compared to a conventional dry toner, the liquid toner dispersion made by dispersing toner in a carrier provides a liquid toner dispersion which does not agglomerate easily; therefore, a resin having a lower softening temperature can be used therein, making it possible to lower the temperature of the transfer roller 15. Note that in this embodiment, when the belt 3 is driven at a speed of 90 mm/s, setting the surface temperature of the transfer roller 15 to be 80° C. makes the transfer excellent. The transfer temperature is lower than the fixing temperature (170° C.) of a conventional dry toner.

According to the recording method of this invention, the toner is ejected using electrical repulsion; therefore, the toner-charging degree should also be stabilized. When being measured as a zeta potential, it is preferable that the toner-charging degree be 60 mmV or more. Note that a Laser G-Meter M-501 manufactured by US PEN KEM Co. was used for measuring zeta potential.

Although a large diameter is suitable for the particles due to their faster electrical-drifting speed, it has a drawback in that precipitation is easily caused. When the particles having average diameter of 0.01 micrometer or less are used, a blurred image is formed probably because it is difficult for the particles to be separated from the carrier. In order to not cause the blur or fluidity even when recording, for example, on a metallic surface, it is preferable to have a toner particle of 0.1 micrometer or larger. Even when depending on a precipitation-preventing mechanism in a recording apparatus, it is difficult to use large particles of more than about 5 micrometers due to their rapid precipitation. In other words, it is necessary to properly select the particle diameter of the toner according to the apparatus. For example, if the image-forming apparatus is used intermittently, a particle diameter of 4 micrometers or less is preferred.

In a preferred embodiment of this invention, there is also provided a transport means for transporting a recording medium, such as paper, toward the image holder; and a heating means in which the image formed on the image holder is heated, fused, and transferred onto the recording medium, and the transferred image is fixed onto the recording medium.

It is preferred also that the transport means be synchronized with the image formed on the image holder by the image-forming means and transported in a predetermined direction together as the image holder is driven.

It is also preferred to provide a transfer means for electrostatically transferring the image formed on the image holder onto the recording medium which has been transported by the transport means.

In a yet more detailed description, the image-forming apparatus of this invention comprises:

a belt-like image holder having an image-holding surface which is endlessly driven at a constant speed with the image-holding surface on the outside; a supply means which supplies pigmented particles to a plurality of ejection points distanced from the image-holding surface at a predetermined interval, the particulate dispersion being made by dispersing charged particles in an insulating carrier liquid; a plurality of projections from said ejection points toward the image-holding surface; a plurality of partition walls which project between each of said ejection points toward the image-holding surface and separate the particles supplied by the supply means for each of the ejection points; a recovery means for recovering excess dispersion supplied to each of the ejection points by said supply means; a plurality of recovery paths formed between adjacent partition walls for directing, to the recovery means, the particles supplied to each of the ejection points by the supply means; an image-forming means in which an electric field is formed directed to the image-holding surface from the ejection points selected according to the image signal, the pigmented particles in the particulate dispersion are agglomerated near the point of projection at said selected ejection points, and the agglomerated particles flow toward the image-holding surface to form an image thereon according to the image signal; a transport means which transports a recording medium to a predetermined transfer location adjacent to the image-holding surface, being synchronized with the image formed on the image-holding surface by the image-forming means and transported in a predetermined direction as the image holder is driven; and a transfer means for transferring the image formed on the image-holding surface onto the recording medium which has been transported to the transfer location by the transport means.

BRIEF DESCRIPTION OF THE DRAWINGS

FIG. 4 is a perspective view showing a print head of a first embodiment, installed in the recording unit of FIG. 3;

FIG. 5 is a plan view of the print head of FIG. 4 seen from the top;

5 FIG. 6(A) is a front view of a supporting member which constitutes the print head of FIG. 4; and FIG. 6(B) is a side view of the supporting member of FIG. 6(A);

FIG. 7 is a drawing showing a guide film installed in the print head of FIG. 4;

FIG. 12 is a perspective view showing the print head of a third embodiment of this invention; and FIG. 13 is a cross-sectional view of the print head of FIG. 12 crossed along line A—A.

DETAILED DESCRIPTION OF THE DRAWINGS

Figure 1:
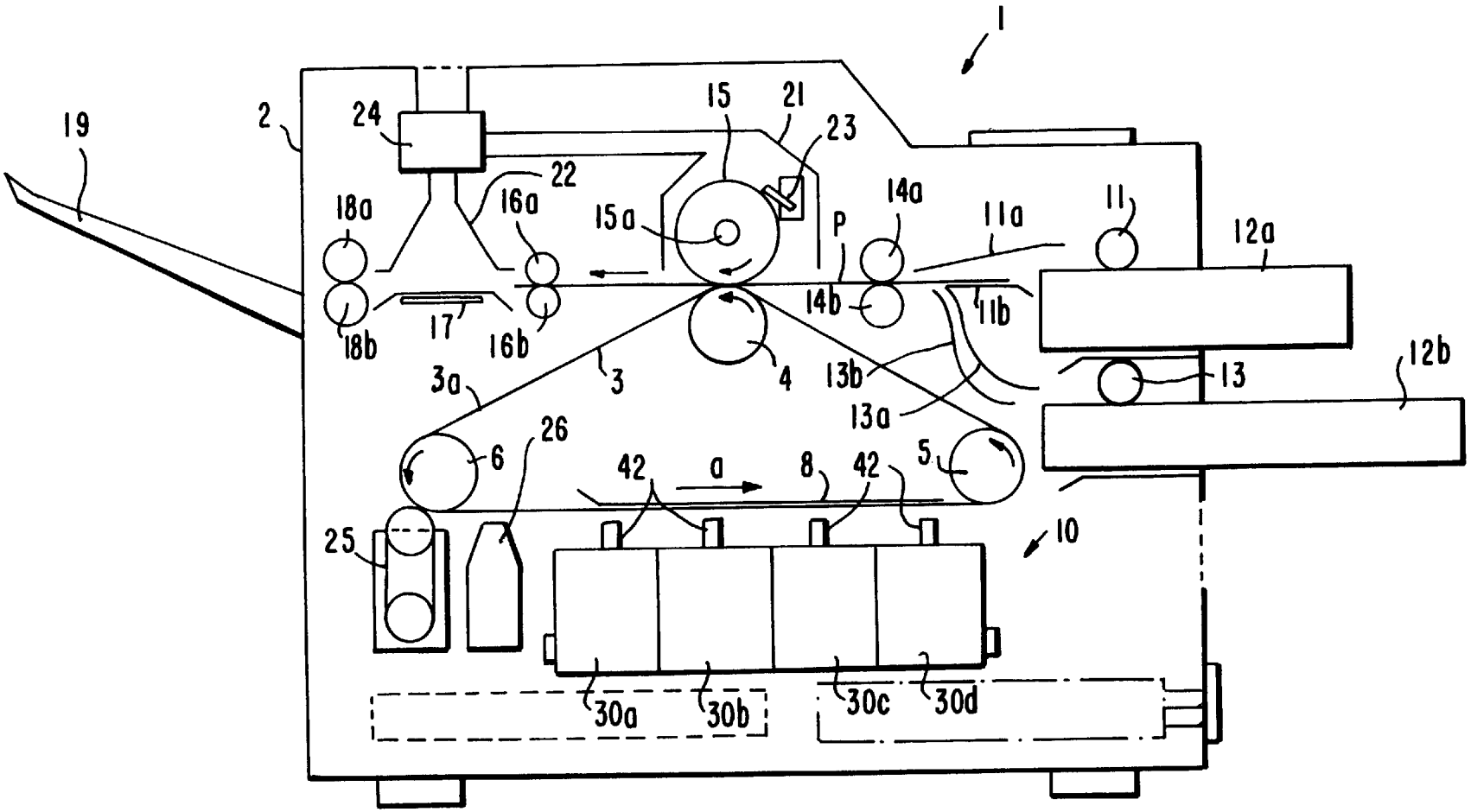
FIG. 1 is a drawing showing an ink jet printer as an image-forming apparatus of this invention.

As shown in FIG. 1, an ink jet printer 1 (an image-forming apparatus of this invention) has a housing 2. Provided at the predetermined center location in the housing 2 is a belt 3 which is driven endlessly in the direction of the arrow in the figure.

A color image is to be formed, by a toner delivery apparatus 10 (to be described later), on the outer surface 3*a* (an image-holding surface) of the belt 3. The image formed on the outer surface 3*a* of the belt 3 is carried to a predetermine transfer location as the belt 3 moves; the image is then transferred onto a printing paper P (recording medium) which has been synchronously transported. In other words, the belt 3 temporarily holds the image formed by the toner delivery apparatus 10, and, at the same time, acts as an interim image holder for the image, which transfers the holding image onto the printing paper P. Note that the width of the belt 3 is set to be at least wider than the width of the printing paper P.

Each component of the ink jet printer 1 is described hereinafter. The belt 3 is tensioned being held by three rollers 4, 5, and 6 which are arranged at predetermined locations in the housing 2. The roller 4 is positioned such that the belt 3 roll-contacts a transfer roller 15 (to be described later) at the image transfer location; the rollers 5 and 6 are positioned such that the belt 3 between the rollers 5 and 6 runs in a horizontal plane created between the rollers 5 and 6. By rotating the rollers 4, 5, and 6 by a motor (not illustrated), the belt 3 is driven at a predetermined speed in the direction of the arrow in the figure.

Figure 2A:
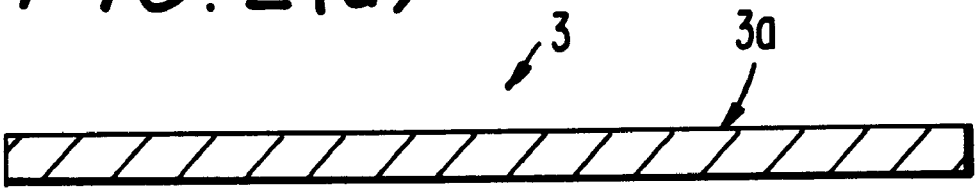
FIG. 2 is a cross-sectional view showing a belt installed in the ink jet printer of FIG. 1.
Figure 2B:
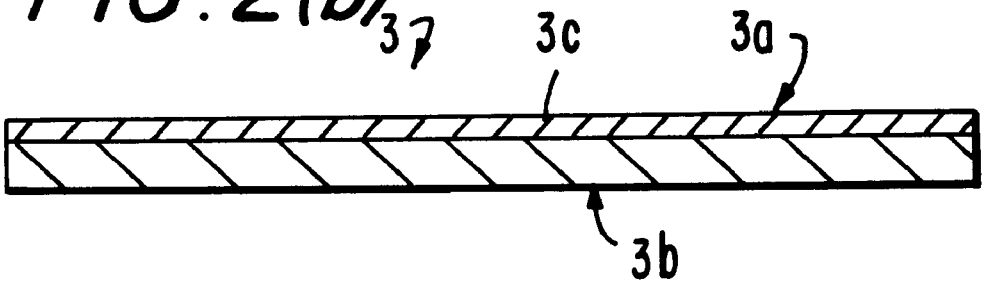

Now the belt 3 is described in detail. The belt 3 is, as shown in FIG. 2(A), formed of metal having an appropriate surface roughness. As shown in FIG. 2(B), the belt 3 is formed by coating a metallic belt 3*b* of stainless steel or the like with a silicone resin, a silicone rubber, a fluoroplastic such as polyethylene fluoride, or a polyimide to a predetermined thickness. The outer surface 3*a* of the belt 3 is made of a material having excellent peelability of the toner (to be described later) and excellent heat resistance. Also the belt 3 should maintain a precise gap created with a print head (to be described later). For this reason, the coating is formed of a material having excellent abrasion resistance.

As shown in FIG. 2(B), the belt 3 is formed by coating the metallic belt 3*b* with a coating as described above. The coating layer 3*c* is set to an appropriate thickness, taking account of peelability of the toner held on the belt 3, uniformity of the pressure applied during transfer, and the required usable life based on wear characteristics. When coating silicone rubber, for example, it is preferable to set the layer thickness to about 50 $\mu$m to about 200 $\mu$m.

In either case, using an insulating material for the outer surface 3*a* of the belt 3 may cause electrostatic charges due to triboelectrification and the like. If the belt 3 is statically charged in this way, the electric field may be disordered during image formation, creating poor images. For this reason, when an insulating material is used for the belt 3, it is preferable to decrease the electrical resistance of the coating material by impregnating it with a conductive filler such as carbon, zinc oxide, titanium oxide, and the like. Also, if the charging potential of the belt 3 is controlled by a corona-charging device, etc., insulating material without an impregnated conductive filler may be used.

Arranged at a predetermined location under the belt 3 is a toner delivery apparatus 10 (an image-forming means) for forming a color image on the outer surface 3*a* of the belt 3 according to the image signal. The toner delivery apparatus 10 has four separate units 30*a*, 30*b*, 30*c*, and 30*d* (to be described later) arranged along the driving direction of the belt 3 in parallel. These delivery units contain each color liquid dispersal type of the toners (black, cyan, magenta, and chrome) (black, blue, red, and yellow, respectively); from the top end of each of the toner delivery units, the end of a print head (to be described later) is projected. The end of each of the print heads is arranged at an ejection location distanced at a predetermined interval from the belt 3 horizontally running between the rollers 5 and 6.

In each of the toner delivery units 30*a*, 30*b*, 30*c*, and 30*d*, black, cyan, magenta, or chrome liquid dispersion of toner is respectively stored; when the image signals which are separated, according to colors, from a signal source (not illustrated) is applied to each of the delivery units, an electric field is formed from the top end of each of the print heads toward the belt 3 according to the color-separated image signal, the toner flows onto the outer surface 3*a* of the belt 3 to form an image for each color. At that time, the four color images separated by a synchronous means (not illustrated) are accurately superimposed on the outer surface 3*a* of the belt 3 to form one color image. Note that each of the delivery units is configured the same as one another except for the printing ink color. Therefore, these units will be described below as a toner delivery unit 30.

Provided inside the belt 3, i.e., on the side opposite the toner delivery apparatus 10 is a grounded electrode plate 8 for forming a predetermined electric field with each of the print heads. If necessary, a predetermined voltage is to be applied to the electrode plate 8 by a power source (not illustrated). Also, the electrode plate 8 is held closely in parallel to the belt 3 to control vibration of the belt 3 in order to maintain a constant gap between the belt 3 and the end of the print head.

If the belt 3 is formed of a conductive material, the electrode plate 8 is not always required. That is, even when the electrode plate 8 is not used, the belt 3 is conductive, and one of the rollers 4, 5, and 6 around which the belt 3 is wound is used as an electrode, and a predetermined electric field can be generated between the belt 3 and the print head.

Provided at the right side (in the figure) of the belt 3 are paper cassettes 12*a* and 12*b* in which a number of sheets of paper P are loaded. Paper P of different sizes is stored in each of the paper cassettes 12*a* and 12*b*; each of the paper cassettes 12*a* and 12*b* is mounted to the housing 2 such that its leading end is positioned inside of the housing 2 and its tail end is outside of the housing 2. At the positions close to the leading end of each of the paper cassettes 12*a* and 12*b*, feeding rollers 11 and 13 are respectively provided which roll-contacts paper P on the top of the stack in each of the trays 12*a* and 12*b*, and feeds paper P from the top, one by one.

On each of the transporting paths for printing paper P, downstream of the feeding rollers 11 and 13, pairs of transport guides 11*a*, 11*b* and 13*a*, 13*b* are arranged so as to sandwich the printing paper P. Downstream of the transport guides 11*a*, 11*b*, 13*a*, 13*b*, a pair of transport rollers 14*a* and 14*b* are provided which hold and transport the printing paper P transported through each guide toward a predetermined transfer location between the roller 4 and a transfer roller 15.

The transfer roller 15, which roll-contacts the roller 4, is formed of a material having excellent peelability and heat resistance in the same manner as the belt 3; it may use the national used for a conventional electrophotographic copier. Provided in the transfer roller 15 is a heater 15*a* which is heated to a temperature from about 70° C. to about 100° C. The heater 15*a* is configured to be heated to the temperature at which a toner image formed on the printing paper P through the toner delivery apparatus 10 can be fused or softened. Note that the heater 15*a* may be provided in the roller 4.

The toner image on the belt 3, which has passed between the roller 4 and the transfer roller 15 and has been fused or softened by the heater 15*a*, is press-adhered onto the printing paper P between the roller 4 and the transfer roller 15. In this manner, the toner image is transferred and fixed onto the printing paper P. In other words, since the outer surface 3*a* of the belt 3 is formed of a material having high peelability, and the printing paper P has a stronger attraction for the toner, the toner image formed on the outer surface 3*a* of the belt 3 is completely transferred onto the printing paper P.

By applying a voltage having a reverse polarity to the charging polarity of the toner to the transfer roller 15 instead of utilizing the heater 15*a*, the toner image formed on the belt 3 can be transferred onto the printing paper P in the same manner as in the electrostatic transfer technique by conventional electrophotographic technology. In this case, from about 500V to about 1000V of voltage may be applied to the transfer roller 15.

On the transport path downstream of the transfer roller 15, a pair of transport rollers 16*a* and 16*b* are provided which hold and transport the printing paper P having the transferred toner image that passed between the roller 4 and the transfer roller 15. Further, downstream of the transport rollers 16*a* and 16*b*, a heater plate 17 is provided for drying the toner transferred and fixed onto the printing paper P.

The heater plate 17, provided for drying the image transferred onto the printing paper P, needs to be heated to a temperature of about 100° C. to fix the toner image transferred onto the printing paper P when using an electrostatic transfer technique in which a predetermined voltage is applied to the transfer roller 15 to transfer the toner image.

The printing paper P passes very closely above the heater plate 17 but without contacting the heater plate 17. Provided downstream of the heater plate 17 are a pair of output rollers 18*a* and 18*b* for holding and placing the printing paper outside of the housing 2. Downstream of the output rollers 18*a* and 18*b*, and on the left side end (in the figure) of the housing 2, an output tray 19 is projected for receiving the printing paper P placed outside of the housing 2 via the output rollers 18*a* and 18*b*.

A sheet of printing paper P is taken out of a predetermined paper cassette 12 by the feeding roller 11 or 13; synchronizing the movement of the image formed by the toner delivery apparatus 10, the paper P is fed to the transfer location between the roller 4 and the transfer roller 15 via the transport guide 11 or 13 and the transport rollers 14*a* and 14*b*. Then, the printing paper P is carried at the same speed as the belt 3; a toner image is transferred thereon when the paper P passes under the transfer roller 15; then the paper P is put onto the output tray 19 via the transport rollers 16*a* and 16*b* and the output rollers 18*a* and 18*b*. At that time, the printing paper P on which the toner image is transferred is passed above the heater plate 17, and the carrier attached to the toner is dried.

Provided above the transfer roller 15 is a duct 21 enclosing the transfer roller 15; provided above the heater plate 17 is a duct 22 enclosing the heater plate 17. Each duct 21, 22 collects gas generated in the carrier by heating, and sends the gas to a decomposer 24 that separates the gas. The decomposer 24 functions the same as a catalytic device that separates the exhaust from a car; it separates the gas into water and carbon dioxide and discharges them, preventing odor from being generated.

Above the outer surface of the transfer roller 15, a cleaning blade 23, for sweeping off the toner, is contacted to the outer surface of the transfer roller 15 at an acute angle. This blade can be made of silicone resin.

Provided under the roller 6 is a wiper system 25 for wiping off any excess toner adhered to the belt 3. The wiper system 25 roll-contacts the roller 6, and has a felt or brush, to which the carrier in the toner is impregnated, to wipe off any residual toner attached on the surface of the belt 3 by friction-contact.

Provided between the wiper system 25 and the toner delivery apparatus 10 is a dryer 26 for blowing warm air toward the outer surface 3*a* of the belt 3. In other words, when the toner is cleaned up by the wiper system 25, the outer surface 3*a* of the belt 3 can become slightly wet. If the belt 3 is wet to a great extent, a poor image may be formed on the outer surface 3*a* of the belt 3 due to blur and fluidity. For this reason, the belt 3 needs to be fully dried for the next printing operation.

Next the above mentioned toner delivery unit 30 is described in detail.

Figure 3:
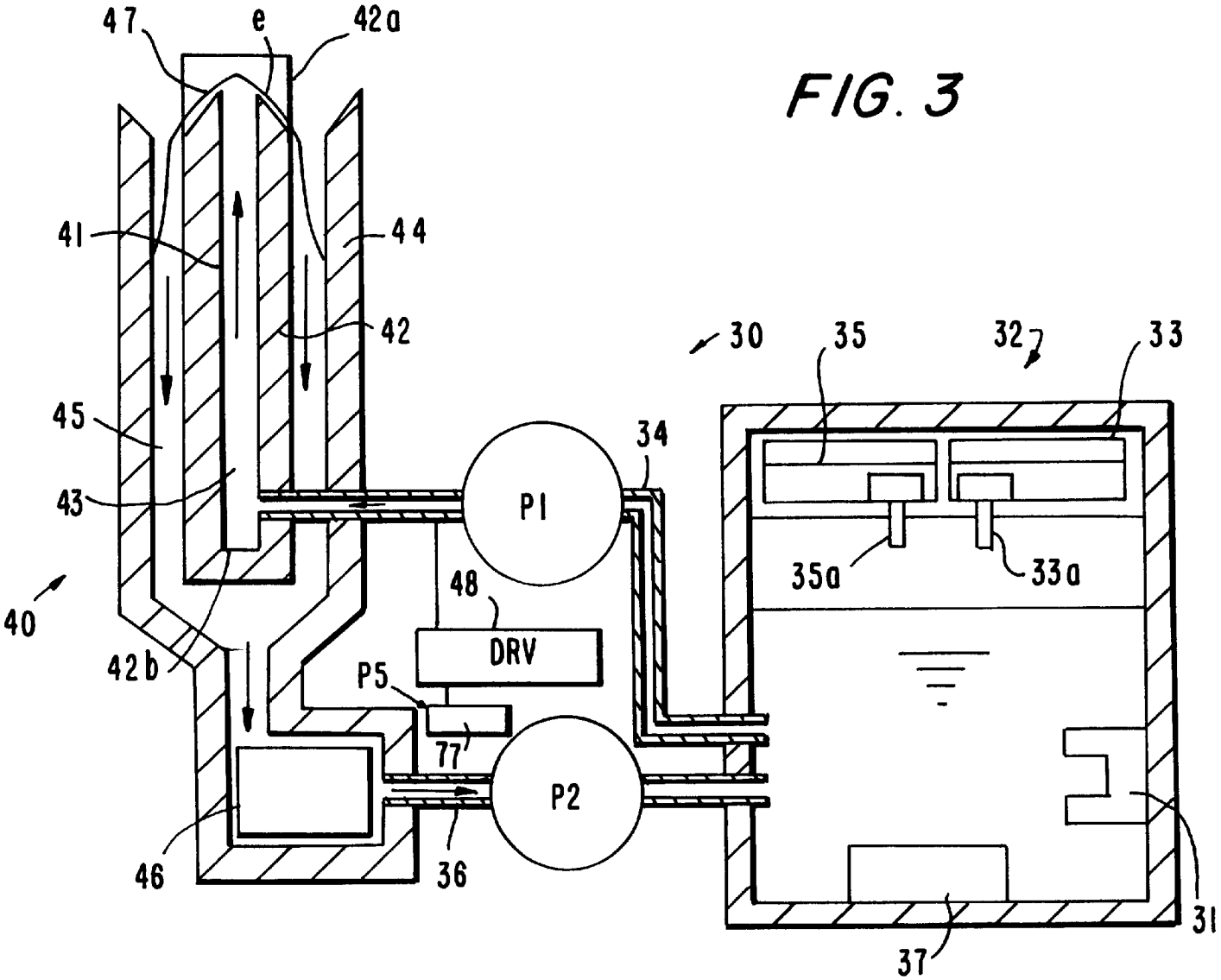
FIG. 3 is a drawing showing a recording unit installed in the ink jet printer of FIG. 1.

FIG. 3 shows the delivery unit 30 in detail. The delivery unit 30 comprises a head unit 40 provided under the belt 3 (an interim toner medium), and a liquid tank 32 for storing a liquid dispersed toner to be circulated in the head unit 40. Note that the liquid dispersed toner to be used here is made by dispersing charged toner into a dielectric carrier liquid. The toner is used in four separate colors (black, cyan, magenta, and chrome).

The head unit 40 has a rectangular print head 42 (to be described later) that extends perpendicularly downwardly under the belt 3. The print head 42 has a top end 42*a* which faces the surface of the belt 3 at a predetermined distance; it is arranged such that a longer axis of the top end 42*a* crosses the transport direction of the printing paper P, i.e., crosses the belt 3 driving direction. Note that in this embodiment, the top end 42*a* of the print head 42 is distanced by from about 0.1 mm to about 3 mm from the bottom surface of the belt 3. The distance between the top end 42*a* of the print head 42 and the bottom surface of the belt 3 is determined according to the magnitude of the recording voltage (to be described later) applied to the print head 42.

Near the top end 42*a* of the print head 42, a plurality of openings are formed in parallel to the longer axis direction of the top end. Formed inside of the print head 42 are a plurality of supply paths 43 through which the liquid dispersed toner individually passes from the vicinity of the bottom end 42*b* of the print head 42 toward each of the openings. Each of the supply paths 43 is formed extending perpendicularly in parallel to one another.

The head unit 40 also has a guide member 44 enclosing the side and bottom surfaces of the print head 42. The guide member 44 supports the print head 42 at a predetermined location, and constitutes a liquid recovery path 45 with the outer wall of the print head 42. In other words, the printing ink supplied to the print head 42 is raised inside of the print head 42 via each of the supply paths 43 to overflow from each of the openings at the top end 42*a*. The excess liquid overflowed from the openings runs down along the outer wall of the print head 42 to be recovered through the liquid recovery path 45.

In a space below the guide member 44 and in communication with the liquid recovery path 45, a filter 46 is provided for passing the recovered excess liquid to remove foreign matter in the liquid. Note that the filter 46 has an aperture of a size which does not prevent the toner in the liquid from passing through.

Further, the head unit 40 is provided along the inner surface of each of the supply paths 43 in the head 42 and has a plurality of electrodes 41 with the tip e of the electrodes distanced a predetermined interval from the belt 3. Each of the electrodes 41 is connected to a driving circuit 48 which is, in turn, connected to a power source 77. The driver circuit 48 changes the magnitude of the voltage applied to the electrodes 41 from the power source 77 for selectively controlling image formation. For example, the driving circuit 48 may supply +200v as bias voltage for forming an agglomeration of charged toner particles in the dispersion. Bias voltage having the same polarity as that of the toner is supplied to the electodes 41 for causing agglomeration of toner in the dispersing liquid. When the bias voltage of same polarity is supplied to the electrodes 41 an electric field is formed between the electrodes 41 and belt 3. The charged toner moves in the insulated carrier liquid toward the tip of the electrodes 41 because of electrical repellant which causes the moving toners to gather and gradually form an agglomeration of toner particles near the tip of the electrodes 41.This agglomeration is attracted electrically toward the belt 3, but the agglomeration can't fly toward the belt 3 because of surface tension of the dispersion. The driving circuit 48 changes the magnitude of the voltage supplied to the electrodes 41 from the power source 77 in order to supply recording voltage. Recording voltage having the same polarity as that of the toner and being larger in magnitude than that of the bias voltage is supplied from the driver circuit 48 to the electrodes 41 to cause the agglomeration of toner particles to fly toward the belt 3. For example a voltage of 400v is supplied to the electrodes 41 in accordance with image signals. When the recording bias voltage is supplied to the elected electrodes 41 the agglomeration of toner is separated from the insulated carrier because of great repellant force and the agglomerated particles fly to the belt 3. An image of toner is formed on an image bearing member, for example, a paper located on the belt 3.

A liquid tank 32 storing the liquid dispersed toner is provided at the right side (in the figure) of the head unit 40. Connected between the head unit 40 and the liquid tank 32 is a supply tube 34 for supplying the liquid dispersed toner stored in the tank 32 to the supply paths 43 inside of the print head 42. At about halfway in the supply tube 34, a pump P1 is provided for pumping up the liquid dispersed toner in the tank 32 at a predetermined discharge rate and pressure.

Connected between the head unit 40 and the liquid tank 32 is a liquid recovery tube 36 for recovering excess liquid, which is recovered through the recovery path 45 and has passed through the filter 46, to the liquid tank 32. At the halfway point in the recovery tube 36, a pump P2 is provided for sending to the liquid tank 32 the excess liquid overflowed from the top of the print head 42. Note that the pump P1, the liquid supply tube 34, and the supply paths 43 function as a supply means of this invention; the liquid recovery path 45 (guide member), the liquid recovery tube 36, and the pump P2 function as a recovery means of this invention.

Provided inside of the liquid tank 32 is a density-measuring system 31 which measures the density of the toner in the liquid dispersion by measuring optical transmittance of the liquid dispersion stored in the tank 32, a toner storage 33 for storing toner of a predetermined density, a carrier liquid storage 35 for storing carrier liquid, and a stir system 37 for stirring the liquid dispersion stored in the tank 32.

In the toner storage 33, a toner supplier 33*a* is provided for refilling the consumed amount of toner in the liquid dispersion, according to the toner density measured by the density measurement system 31. In the carrier storage 35, a carrier supplier 35*a* is provided for refilling the carrier in the liquid dispersion for shortage. Therefore, the liquid dispersion in the tank 32 is constantly stirred, and at the same time, the toner density is always monitored to be adjusted to a predetermined value.

When circulating the liquid dispersed toner in the toner delivery unit 30 configured in the above manner, the carrier liquid containing dispersed toner pumped up from the tank 32 by pump P1 is first supplied through the supply tube 34 to the plurality of supply paths 43 in the print head 42. The carrier liquid containing dispersed toner supplied to each of the supply paths 43 is raised in each of the paths 43, and overflows from the openings at the top end 42*a* of the print head 42. At that time, a plurality of carrier liquid meniscuses 47 corresponding to the openings of the supply paths 43 are formed near the top end 42*a* of the head 42. The excess liquid overflowed from the openings at the top end 42*a* of the print head 42 runs down, passing through the recovery path 45, to be guided to the filter 46. The toner dispersed liquid passes through the filter 46 to remove foreign matter, is sucked by the pump P2, and then sent to the tank 32.

The printing operation of an ink jet printer 1 of this invention configured in the above manner is described, as follows:

First, the heater 15*a* and the heater plate 17 are electrified and heated to a predetermined initial temperature. As mentioned above, in each of the toner delivery units 30*a*, 30*b*, 30*c*, and 30*d*, the carrier liquid containing dispersed toner is circulated and supplied toward the tip of the electrode 41 to form a predetermined carrier meniscus 47 at each of the openings at the end of each of the print heads 42. Applied to the electrode 41 is a predetermined bias voltage; the toner in the carrier liquid is agglomerated at the meniscus according to the bias voltage.

When color-separated signal images are respectively input to the driving circuit 48 of each of the recording units 30*a*, 30*b*, 30*c*, and 30*d* from a signal source (not illustrated), the belt 3 is driven at a constant speed in the direction of the arrow, and a recording voltage larger than the bias voltage which has previously been applied is selectively applied to each of the electrodes 41 of the print head 42. Then, a predetermined electric field is formed between the belt 3 and the electrode 41 which is selected according to the color-separated image signal; whereby, the agglomeration of charged toner is separated and ejected from the top of the carrier meniscus 47, and is delivered to the outer surface 3*a* of the belt 3. With this, a toner image according to the color of carrier liquid containing dispersed toner is formed in sequence on the outer surface 3*a* of the belt 3, superposed by a synchronization means (not illustrated) to form a predetermined color image on the belt 3 according to the image signal.

The toner image (color image) formed on the outer surface 3*a* of the belt 3 is carried together with the driving of the belt 3, and transported to the transfer location between the roller 4 and the transfer roller 15.

Synchronized with the movement of this image, the feeding roller 11 or 13, and the transport rollers 14*a* and 14*b* are driven, and a sheet of printing paper P stored in the paper cassette 12*a* or 12*b* is taken out and sent to the transfer location.

The printing paper P sent to the transfer location being synchronized with the toner image is heated by the heater 15*a*, and at the same time, is press-held between the roller 4 and the transfer roller 15, and the toner image is fused or softened to be transferred onto the printing paper P.

The printing paper P with the toner image transferred is held and transported by the transport rollers 16*a* and 16*b*, is passed above the heater plate 17 to fully dry the toner image, then held by the output rollers 18*a* and 18*b* to be put out onto the output tray 19.

The gas generated by the carrier during transfer and drying is collected by the duct 21 above the transfer roller and the duct 22 above the heater plate 17, is separated into water and carbon dioxide through the decomposer 24, and is discharged outside of the apparatus.

The toner attached on the outer surface of the transfer roller 15 and the residual toner on the outer surface 3*a* of the belt 3 are respectively removed by the cleaning blade 23 and the wiper system 25. After that, the belt 3 is dried by the dryer 26 to be ready for the next printing operation.

According to the image-forming apparatus of this invention, the belt 3 has excellent peelability of the toner image and heat resistance is used as an interim image holder to temporarily hold a toner image on its outer surface 3*a*, and carries the toner image to the transfer location by the movement of the belt 3 to transfer the image onto the printing paper P.

Thus, the printing paper P is not interposed between the print head 42 and the belt 3 (image holder), and therefore, the gap therebetween can be extremely narrowed. In this embodiment, the distance between the end of the print head 42 and the outer surface 3*a* of the belt 3 can be narrowed to about 100 $\mu$m. Note that this distance can be narrower if the finishing precision is further refined.

By narrowing the gap between the print head 42 and the belt 3, the recording voltage to be applied to the head 42 can be lowered to from about 100V to about 300V. Consequently, the driving circuit 48 can be highly integrated, remarkably improving the productivity of the apparatus and reducing the manufacturing cost.

According to this invention, the gap between the print head 42 and the belt 3 is set to a predetermined value regardless of the thickness of the paper P, which provides greater choice of selection of printing paper P.

Further, since the printing paper P is not interposed between the print head 42 and the belt 3, the gap therebetween is maintained constant; therefore, a stable electric field can be formed from the print head 42 to the belt 3, making it possible to form a clear and stable image.

The print head 42 of the first embodiment of this invention, which is installed in the head unit 40, is further described in detail.

FIG. 4 is a perspective view of the print head 42; FIG. 5 is a plan view of the print head 42 seen from the top end 42*a* side. The print head 42 has a pair of rectangular supporting members 51 and 52 and a rectangular guide film 59 held between the supporting members 51 and 52.

The supporting members 51 and 52 are formed by a 1 mm to about 10 mm thick material, preferably a plastic, ceramic, or the like, having high electric resistivity of about $10^{12}$ Ω·cm or more of insulation (although the higher resistivity is better, it is preferable to use polyether ketone or polycarbonate suitable for precision machining).

The guide film 54 is formed of high-resistance material from about 30 $\mu$m to about 200 $\mu$m thick (a material having resistivity of $10^{11}$ Ω·cm or more. This guide film can be made of a resin material of, for example, polyether sulfone, polyether, polyethylene, fluoroplastics, polyimides, polypropylene, and the like, or various ceramic materials).

FIGS. 6*a* and 6*b* show one of the supporting members, 51. On one of the surfaces of the supporting member 51, i.e., the inner surface which would face guide film 54 (FIG. 7), a plurality of rectangular grooves 5la are formed in parallel to one another. The grooves 5 la are formed according to the resolution number of the recording such that they constitute a plurality of supply paths 43 incorporating with the grooves (not illustrated) formed on the other supporting member 52 in the same manner when the print head 42 is assembled (shown in FIG. 4).

Each groove 51*a* is formed from about 50 $\mu$m to about 500 $\mu$m deep and from about 100 $\mu$m to about 1000 $\mu$m wide. The end of the groove 51*a* extends slightly longer than the end of the supporting member 51 (constituting the top end 42*a* of the print head 42 when assembled), and the base end of the groove 51*a* extends beyond the center of the supporting member 51. The base end extending beyond the center of the supporting member 51 is communicated with a rectangular recess 51*b* having the same depth as the groove 51*a*. The recess 51*b* constitutes a liquid containing toner dispersion reservoir 53 incorporating with a recess (not illustrated) formed on the other supporting member 52 in the same manner. Connected to the toner dispersion reservoir 53 is the above-mentioned supply tube 34 for supplying the liquid containing toner dispersion.

By forming a plurality of grooves 51*a* on the inner surface of the supporting member 51 in this manner, a plurality of rectangular walls 55 is naturally provided for partitioning each of the supply paths 43. The leading ends of the grooves 51*a* of the supply paths 43 extending between each of the walls 55 constitute openings 56 (see FIG. 5) of the supply paths 43 at the position receded by a predetermined distance (50 $\mu$m to 500 $\mu$m) from the top ends 55*a* of the walls 55, i.e., the top end 42 of the print head 42.

Formed between the adjacent walls 55 and at the edge of the 5 opening 56 at the end of the path 43 is a liquid recovery groove 57 (recovery path) which is slanted down toward the outer surface 51c of the supporting member 51. The recovery groove 57 is set such that its width is the same as that of the opening 56, and its slope angle is 65° or smaller.

Moreover, on the surface of the groove 51*a* formed on the supporting member 51, i.e., on the inner surface of the supply path 43, the electrode 41 made of a conductive material by non-electric field plating is extended to the opening 56 and formed in a 2 $\mu$m to 30 $\mu$m thickness. Each of the electrodes 41 is formed of a metal such as gold, copper, chrome, aluminum, nickel, and the like, or an alloy containing these metals, and is electrically connected to the driving circuit 48.

Note that the other supporting member 52 is formed symmetrical with the above-mentioned supporting member 51, and they are overlaid such that their grooves coincide with one another. At that time, a guide film 54 (to be described below) is sandwiched between the supporting members 51 and 52 to constitute a print head 42.

As shown in FIG. 7, the guide film 54 is formed rectangular, and has the top end 54*a* having the length equal to the width of the top end 42*a* of the print head 42 when it is held by the pair of supporting members 51 and 52. The guide film 54 has, along the top end 54*a*, triangle projections 59, which have tapered points projected from the top end 54*a*, as many as the grooves in the supporting member. In other words, a plurality of projections 59 integrally formed at the top end 54*a* of the guide film 54 are provided at the same pitch as that of the grooves 51*a* formed in the supporting member 51 (52). The guide film 54 is arranged such that each projection 59 projects by a predetermined length from the opening 56 at the end of each of the supply paths 43. At that time, the guide film 54 is arranged such that the top end 54*a* thereof does not project upwardly from the opening 56 but only the projection 59 projects from the center of the opening 56.

Figure 8:
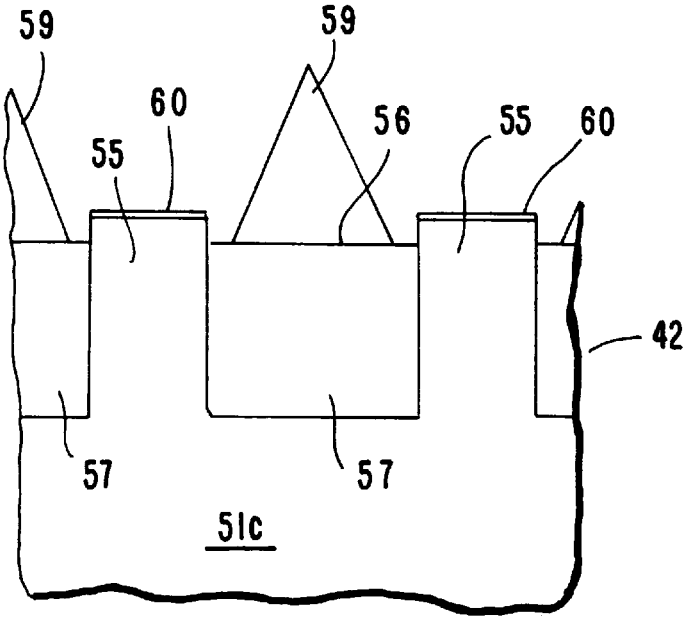
FIG. 8 is a partial magnification of the vicinity of the top end of the print head of FIG. 4.
Figure 9A:
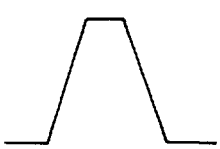
FIG. 9 are modified examples of a projection of the guide film of FIG. 7.
Figure 9B:
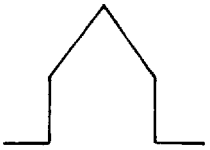
Figure 9C:
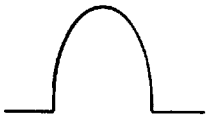
Figure 9D:
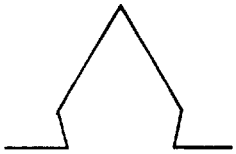

FIG. 8 shows a partial magnification near the top end 42*a* of the print head 42 formed by holding the guide film 54 by the pair of supporting members 51 and 52, i.e., the vicinity of the ejection location of the liquid containing toner dispersion.

The size of the projection 59 formed at the top end 54*a* of the guide film 54 is suitably determined according to the amount of the toner in the carrier supplied through the supply paths 43, the size of the openings 56 of the supply paths 43, to wet a given amount of the projection 59 with the carrier liquid; it is set at least such that the top end of the projection 59 is not soaked in the carrier liquid due to the carrier meniscus formed near the opening 56.

For example, when the width of the opening 56 is 500 $\mu$m, the foot length of the projection 59 is set within the range of about 300 $\mu$m to about 400 $\mu$m, and the height thereof is set within the range of from about 300 $\mu$m to about 1200 $\mu$m. From the measurement of the recording properties of the print head 42, by varying the width and height of the projection 59, stable recording properties can be obtained by setting the foot length of the projection 59 to from half to the same as the width of the opening, and setting the height to from the same to three times the foot length.

The projection 59 can be shaped, for example, as in FIG. 9(*a*) through 9(*d*). That is, any shape of the projection 59 can be used as long as it is tapered from the foot arranged above the top end 54*a* of the guide film 54 toward a tapered point. The projection 59 may also be a rotated body which a flat plate shown as in FIG. 9, for example, is rotated around its center axis; in this case, the projection 59 needs to be sized such that it does not cover the opening 56 of the carrier liquid containing toner supply path 43.

In other words, the outline of the projection 59 may be formed in a shape with which the toner in the carrier liquid can smoothly move to the point of the projection when an electric field directed toward the belt 3 is exerted on the carrier liquid containing toner supplied through the supply paths 43, and is lipophilic with respect to the carrier liquid containing toner. In particular, it is desirable that the projection 59 is formed of a material having 25 dyne/cm or more of critical surface tension which indicates that it is lipophilic.

The wall 55 is provided between the adjacent projections 59, i.e., between the adjacent openings 56 for separating the carrier meniscuses 47 which are individually formed along the each projection 59 near each opening 56. Each of the walls 55 has a top end 55*a* (the top end 42*a* of the print head 42) projected by about 50 $\mu$m to 500 $\mu$m in the printing paper P direction (upwardly) from the opening 56 at the end of the supply path 43. It is desirable that the corners of the wall 55 that face the supply path 43 or liquid recovery groove 57 are chamfered very little or not all. In other words, no chamfer of the corners of the wall 55 contributes to preventing the liquid from permeating at the corners, thus preventing each of the carrier meniscuses 47 from being bridged.

An oil repellent surface 60 is provided at the top end 55*a* of each wall 55. When, for example, isoparaffin is used for the carrier liquid, the oil repellent surface 60 exhibits excellent capability of repelling oil if it is formed of, for example, a fluoroplastic, a fluorine polymer containing paint, a silicone resin, a silicone polymer containing paint, or the like, having 20 dyne/cm or less of critical surface tension. Providing the oil repellent surface 60 at the top end 55 of each wall 55 prevents the adjacent carrier meniscuses from being bridged, even when the wall 55 is as high as the opening 56 at the end of the supply path 43.

Providing the wall configured in the above manner between the projections 59 prevents the adjacent carrier meniscuses from being bridged, and therefore, prevents disorders of the ejecting direction and ejection frequency of the toner, which are normally caused by the bridging of the carrier liquid; consequently, the toner can be ejected with stability. Further, each wall 55 functions so as to regulate both ends of the carrier liquid recovery groove 57 provided, being slanted from the edge of each opening 56 toward the outer surface of the supporting member.

Figure 10:
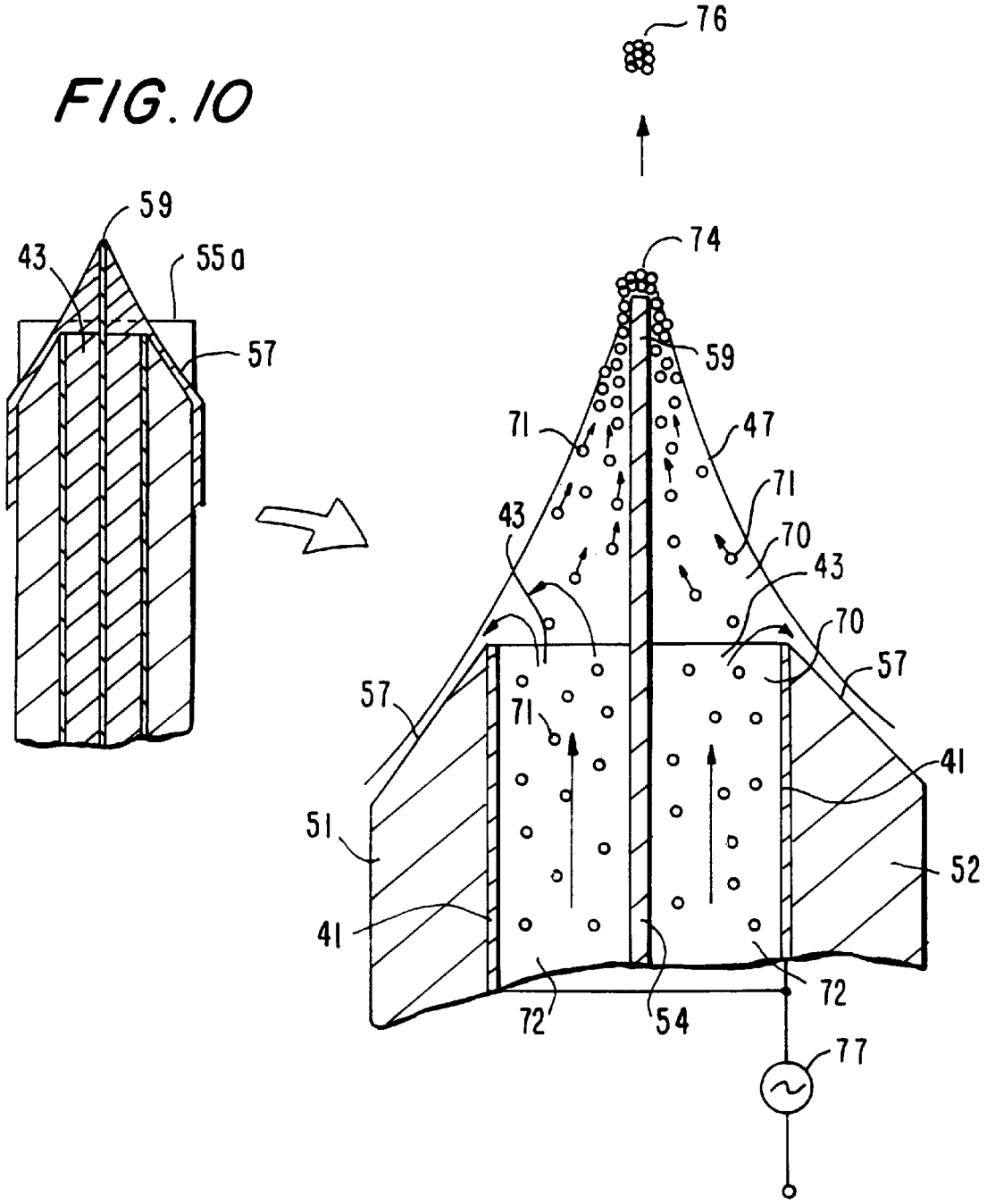
FIG. 10 is a drawing for describing a printing operation in the print head of FIG. 4.

The jet-flow of toner in the print head 42 configured in the above manner is described referring to FIG. 10.

First, the dispersion of toner in the carrier liquid 70 stored in the tank 32 is pumped up via the supply tube 34 by the pump P1, and supplied into the liquid reservoir 53 in the print head 42. When the reservoir 53 is filled with the liquid and toner 70, the liquid and toner 70 is raised through the plurality of supply paths 43, and overflows from the opening 56 at the top of each supply path 43.

The dispersion of toner in the carrier liquid 70 that overflowed from the opening 56 of each supply path 43 starts running through the recovery groove 57 defined by the walls 55 provided at both sides of the opening 56, and runs down along the outer walls 51*c*, 52*c* of each supporting member 51, 52. Then, the liquid and toner 70 is recovered through the recovery path 45, the filter 46, and the recovery tube 36 into the tank 32.

After the liquid and toner 70 is circulated inside of the toner delivery unit 30, the projection 59 of the guide film 54 gets wet with the carrier liquid 70, by means of the applied supply pressure and surface tension of the carrier liquid 70 and the capillary action of the recovery groove 57; the carrier liquid meniscus 47 as shown in FIG. 10 is formed.

In this case, the top end 55*a* of the wall 55 formed between the openings 56 is made higher than the opening 56, an oil repellent surface 60 is provided on the top end 55*a*, and the corners of the wall 55 are not chamfered, to prevent the individual carrier liquid meniscus formed at each opening from being bridged.

With the carrier liquid meniscus 47 formed near each of the openings 56, if a bias voltage of from about 900V to about 1800V (about 1000V when the distance between the point of the electrode 41 and the electrode plate 8 is 500 $\mu$m) is applied to all the electrodes 41 provided along the inner surfaces of supply paths 43, an electric field is formed from each of the electrodes 41 toward the outer surface 3*a* on the belt 3. Because of the electric field, the toner 71 dispersed in the carrier liquid 70 is given an electrostatic repulsive force, and drifts toward the top of the carrier liquid meniscus 47, i.e., the top of the projection 59 of the guide film 54.

In this case, since the carrier liquid meniscus 47 is tapered toward the top, the toner 71 moving toward the top of the carrier liquid meniscus 47 is agglomerated around the top of the projection 59, and the toner agglomerates 74 are formed there. Once the toner 71 is agglomerated, a larger electrostatic force is exerted on the agglomerates 74; however, a bias voltage is set here such that the agglomerations 74 do not flow from the carrier liquid meniscus 47. Also, the distance between the point of each electrode 41 and the electrode plate 8 is set such that the agglomerations 74 do not flow when the bias voltage is applied to each of the electrodes 41.

There is another technique to form an electric field directed from each point of the electrodes 41 toward the outer surface 3*a* of the belt 3. In this technique a voltage is applied having a reverse polarity from the toner to the belt 3 or the electrode plate 8. Moreover, when using the belt 3 made by coating a metallic belt 3*b* with a coating layer 3*c*, as shown as in FIG. 2(B), a desired electric field can be formed by charging the belt 3 to a predetermined potential by corona charging, and the like, in advance. This technique has an advantage in omitting a complicated circuit used for superimposing the ejection voltage onto the bias voltage.

The carrier liquid 72 separated from the toner 71 when the bias voltage is applied to each of the electrodes 41, without moving toward the point of the carrier liquid meniscus 47, flows out from the foot of the carrier liquid meniscus 47 through the recovery groove 57. In other words, the carrier liquid 72 has negative polarity ions due to mutual charging with the toner 71 (positive polarity), so it is not raised by the electric field exerted on the carrier liquid meniscus 47. Therefore, the carrier liquid 72 separated from the toner 71 is forced to flow out from the foot of the carrier liquid meniscus 47 due to surface tension of the carrier liquid (capillary action of the recovery groove 57), gravity, and locally generated electrostatic attraction force.

It is desirable that the recovery groove 57 formed adjacent to each of the openings 56 as the discharging path for the carrier liquid 72 is shaped such that the carrier liquid 72 separated because of agglomerations of the toner 71 is efficiently withdrawn. By efficiently withdrawing the carrier liquid 72, the carrier liquid meniscus 47 can be stabilized, increasing the printing speed and the ejection frequency.

Although the recovery groove 57 can be provided only on one side of the opening 56 (not on both sides), it is desirable to provide it at both sides in order to maintain symmetry of the carrier liquid meniscus. Also although it is preferable to chamfer the edge between the supply path 43 and the recovery groove 57 to efficiently discharge the carrier liquid 72, it may be constructed such that the point of the electrode is exposed, like this embodiment. By exposing the point of the electrode 41 at the edge of the opening 56 in this manner, a strong electric field can be generated.

In the circumstance when the toner 71 and the carrier liquid 72 are separated from one another in the above manner, an ejection voltage is selectively superimposed from the power source 77 toward the electrode 41 as varied by the image signal. The ejection voltage to be superimposed is from about 100V to about 800V; an electric field stronger than that generated during applying bias voltage is generated in the carrier liquid meniscus 47 near the opening 56 having the electrode 41 to which the ejection voltage is applied.

Because of this electric field, an electrostatic force stronger than the force (such as the surface tension) restricting the toner agglomerates 74 is exerted on the toner agglomerates 74. Consequently, the toner agglomerates 74 (recording particles) are separated from the carrier liquid meniscus 47 to flow as the agglomerates 76 toward the image holder. As a result, dots (a toner image) are formed on the image holder by the agglomerates 76; a plurality of electrodes 41 are driven according to the image signal to form a desired image on the image holder.

According to the print head 42 of this embodiment as above-mentioned, the carrier separated from the toner can be forced to be discharged through the recovery groove 57; therefore, the toner and the carrier liquid can be efficiently separated, increasing the toner agglomeration efficiency and the ejection frequency of the agglomerates. For example, in the above described print head 42, from about 500 Hz to about 1 KHz of ejection frequency can be achieved. Note that the smaller the opening diameter of the supply path 43, the higher the ejection frequency tends to be. When the opening diameter is set to 100 $\mu$m, the ejection frequency was measured at 2 KHz.

A technique for increasing ejection frequency without making the opening diameter small may be one in which a conductive material is provided near the point of the projection 59 of the guide film 54. According to this technique, forming a metallic region of about 30 $\mu$m to about 100 $\mu$m at the point of the projection 59 contributes to achieving 2 KHz ejection frequency when the opening diameter is set to be 500 $\mu$m.

Also, the wall 55 defining both sides of the liquid recovery groove 57 and the oil repellent surface 60 provided on its top surface 55*a* prevents the carrier liquid meniscus formed at each opening 56 from being bridged, and the undesirable vibration and disorder in the ejecting direction generated in the carrier liquid meniscus when the agglomerates flow, enabling stable recording and excellent image formation.

Moreover, it is known that the diameter of the agglomerates emitted from the opening 56 varies according to the magnitude of the applied ejection voltage and the applying time. For a carrier dispersion containing toner of 1 $\mu$m-average droplet diameter, when the ejection voltage varies from about 150V to about 600V, the diameter of the agglomerate varies within the range of about 15 $\mu$m to about 200 $\mu$m. Also, the time for applying the signal voltage is changed to 50 to 500 microsecond (at 1 KHz of recording frequency), and the diameter can vary from about 10 $\mu$m to about 300 $\mu$m. As described, adjusting the applied voltage and time can change the diameter of the agglomerates making it possible to flow the agglomerates having small diameters through a wide opening. Consequently, this prevents the carrier liquid supply path from becoming clogged when the dispersion dries, and enables high-density printing.

Although the opening of the above-mentioned print head 42 is formed with a density of 1 to 2 within 1 mm, a plurality of print heads may be overlapped by displacing their openings to create more openings. With this, a print head having a desired toner delivery density can be obtained.

With reference to the print head 42 as described, unlike a conventional ink jet printer in which a liquid is used to form a printing image, toner agglomerations (solid or semi-solid components) are separated from the dispersion to form a printing image. For this reason, there would be no chance to cause poor image, so-called feathering caused when a toner image formed with agglomerates that reach the outer surface 3*a* of the belt 3 flow, or the toner image transferred onto the printing paper P permeates into fibers of the paper due to capillary action and is blurred. Although the carrier liquid and the toner are separated from one another when ejecting the agglomerates, they are not separated completely; the toner reaches the belt 3 being wet due to the carrier liquid. However, there is very little remaining carrier liquid, and it has lost its flowability when the agglomerates reach the outer surface 3*a* of the belt 3, so there is no chance for toner flow. For this reason, a clear image can be recorded even on a receiver such as a metal, plastic, and the like, that has no absorption; when each color image is formed sequentially according to the color-separation image signal, it is not necessary for each color image to be dried, and the next color can be superimposed immediately. Therefore, it is suitable for high speed printing compared to a conventional ink jet.

Figure 11:
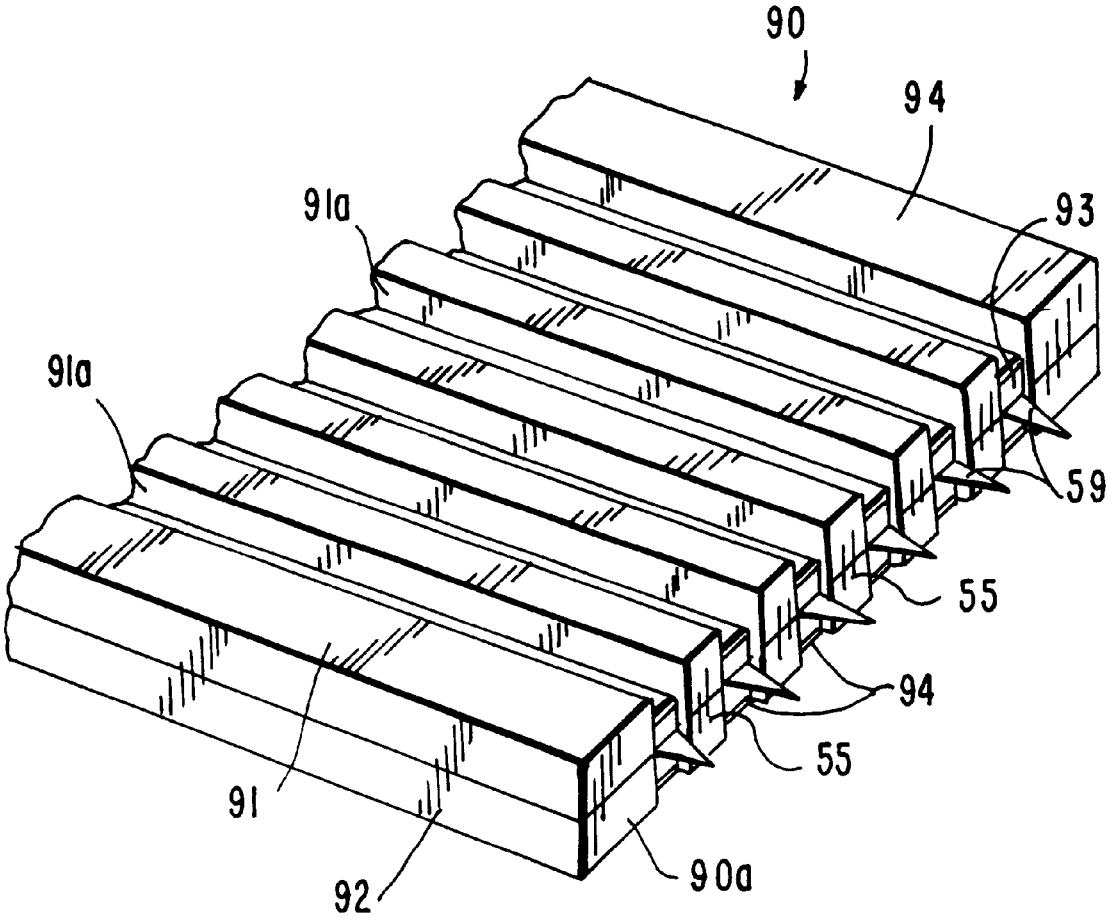
FIG. 11 is a perspective view showing the print head of a second embodiment of this invention.

The print head 90 of a second embodiment of this invention is now described referring to FIG. 11.

As shown in FIG. 11, the print head 90 has a pair of rectangular supporting members 91 and 92. These supporting members 91 and 92 are formed in the same manner as the supporting members 51 and 52 of the print head 42 of the above-mentioned first embodiment. The supporting members 91 and 92 are matched such that the surfaces of the members 91 and 92 having grooves 91*a* and 92*a* thereon do not face each other, but opposite surfaces without the grooves are faced to each other. In other words, the print head 90 has, on its outer surface, a plurality of grooves for flowing the toner dispersed in carrier liquid; a guide film 54 is held between the surfaces of the supporting members 91 and 92 on which the grooves are not formed. A plurality of projections 59 formed at the top end 54 of the guide film 54*a* are projected from the top end 90*a* of the print head 90, corresponding to the grooves formed on the supporting members 91 and 92.

The grooves 91*a* and 92*a* respectively formed on the supporting members 91 and 92 are connected one by one via the top end 90*a* of the print head 90. The rectangular portion 93 at which each groove is connected is recessed by a predetermined distance from the top end 90*a* of the print head 90. That is, at both sides of the rectangular portion 93, the walls 55 are provided for defining each groove formed on each of the supporting members 91 and 92 such that the top end 55*a* of each of the walls 55 projects from the rectangular portion 93. The projection 59 of the guide film 54 projects from the rectangular portion 93 to which an annular electrode 94 is provided enclosing the projection 59.

When circulating the toner dispersed in the carrier liquid in the print head 90 configured in the above manner, the liquid is supplied to each of the rectangular portions 93 through each of the grooves 91*a* formed on the outer surface of one supporting member 91, then is discharged via each of the grooves 92*a* (not illustrated) formed on the other supporting member 92. Although the print head 42 faces the paper P being formed perpendicular thereto in the first embodiment, the print head 90 of this second embodiment is slanted at a predetermined angle to enable the toner to flow. In other words, the print head 90 is slanted such that its top end is used for toner (supporting member 91 side) and its bottom end is used for discharging toner (supporting member 92 side).

After the carrier liquid and toner is sent to the print head 90, the projection 59 gets wet with the carrier liquid 70, and the carrier liquid meniscus is formed at the rectangular portion 93, projection 59, and near the electrode 94. At each of the rectangular portions 93, an independent carrier liquid meniscus is formed. With this condition, a recording voltage is applied from the driving circuit 48 to the electrode 94 selected according to the image signal to flow the agglomerates toward the printing paper P; then a desired image is formed on the paper P.

Even when the print head 90 of this embodiment is used as described, the same operation effect as the case using the print head 42 of the first embodiment can be obtained. Note that a cover for covering the grooves may be provided on the outer surface of each of the supporting members 91 and 92 so that a pipe-like liquid carrier and dispersed toner flowing path is constituted along the outer surface of the supporting members 91 and 92 to thereby force the liquid to circulate. This configuration does not require the print head 90 to be slanted.

The print head 100 of a third embodiment of this invention is now described referring to FIGS. 12 and 13. FIG. 12 is a perspective view of the print head 100; FIG. 13 is a cross-sectional view along line A—A in the figure.

The print head 100 is configured the same as the print head 42 of the first embodiment except for the fact that it has no guide film 54. Therefore, the same codes are used for the same members as the first embodiment, and their descriptions are omitted; only the members different from those in the first embodiment are described.

The print head of the first and second embodiments has projections 59 at the carrier liquid ejection points near the openings; the projections 59 are used for stabilizing the carrier liquid meniscus formed near the ejection points to agglomerate the toner highly efficiently, and for quickly absorbing vibrations from the carrier liquid meniscus generated during ejection of the toner agglomerates, so that the next coming ejection of the toner is not affected. That is, providing the projections 59 can improve the stability of ejecting the toner agglomerates.

However, these projections 59 are not inevitable for this invention. Therefore, the same effects as each of the above-mentioned embodiments can be obtained even when using the print head 100 of this embodiment without a guide film.

In other words, according to the print head 100, the discharge of the liquid overflowed form the opening 56 can be stabilized mainly by the walls 55 and the capillary actions by the liquid recovery grooves 57, thus maintaining a constant shape for the carrier liquid meniscus at the opening 56. Thereby the restoration of the carrier liquid meniscus can be improved, stabilizing the ejection frequency of the agglomerates.

The print head 100 reduces clogging compared to the print head 42 of the first embodiment. In other words, the print head 100 of this embodiment has an advantage that the toner adhesion at the point of the projection 59 due to drying during downtime of the apparatus does not occur, and therefore, provides an advantage in cost and maintenance for a recording apparatus which practically does not require high-speed operation.

Note that this invention is not limited to the above-described embodiments, but is variously modifiable within the scope of this invention. For example, the shape of the opening 56 at the end of the supply path 43 is not necessarily a square, and the cross-sectional shape of the electrode 41 may be any as long as it has a structure which forms an annular or a well-shaped electric field in which the electric field at the center of the opening 56, i.e., at the point of the projection 59 is slightly lower than the periphery. In other words, it may be any as long as it encloses the foot of the projection 59 practically. Specifically, annular, oval-shaped, and the like, cross-section can be possible. Also, an electrode may not cover the entire opening edge, but it may be arranged discontinuously (partially) by being shaped as a horizontal recess, parallel plate, strip, and similar shapes.

Each of the above-mentioned embodiments has used the same width of the wall 55 (the distance between the adjacent openings) as that of the opening 56, but this invention is not limited to this configuration. It may be made smaller. In this case, the wall 55 is made sufficiently high, and the angle of all the comers of the wall 55 are made sharp to enhance the effect of preventing the liquid from spreading. When the wall 55 is formed of a polycarbonate resin or a similar polymer, the corners of the wall 55 are chamfered by less than 100 microns for the use of the liquid carrier containing dispersed toner having a surface tension of about 18 mmN/m to about 30 mmN/m which is used in this invention; when making the surface curved, if the radius of curvature is less than about 100 microns, the carrier liquid meniscuses at the adjacent openings 56 did not bridge during a normal printing.

Further, the arrangement direction of the projection 59 may be set in the direction different by 90° from the above embodiments; the projection 59 can be shaped accordingly. As the foot of the projection 59 is made short, the foot of the carrier liquid meniscus formed around the projection also becomes short, making it difficult for the toner dispersion to climb up the wall, but lessening the amount of the toner agglomeration; therefore, the length of the projection should be adjusted according to the objective. Although in the above-mentioned embodiments, the projection 59 is highly precisely arranged by being formed integral with the guide film 54, it is variously modifiable such that it may be divided in multiple, or configured in a size to be arranged only within the openings. Also, in the embodiments, the projections are all arranged at the centers of the electrodes as a preferable arrangement. However, the scope of this invention also includes to arrange the projection only on a specific side of the groove to simplify the apparatus structure, although the toner delivery effect is slightly deteriorated.

Although in the above embodiment, a bias voltage is applied to the electrodes 41, the bias voltage may be applied to the electrode plate 8 as the opposite electrode (or the belt 3). In short, it is good as long as the bias voltage strong enough to record is applied between each of the electrodes 41 and the belt 3.

As described above, since the image-forming apparatus of this invention has the above-mentioned structure and operations, it can be manufactured in large quantity with inexpensive cost, widening the variety of the choice of toner delivery medium and forming a stable image.

What is claimed is:

1. An image recording apparatus comprising:

image forming means for forming a color image, said image forming means including a plurality of recording units, each recording unit respectively including an electrode and a color liquid dispersion different from the remaining units each color liquid dispersion being made by dispersing charged toner particles into an insulating carrier intermediate image receiving means movable in a predetermined direction and facing said plurality of recording units for receiving the color image formed by said image forming means, said plurality of recording units being arranged in parallel along said predetermined direction of said intermediate receiving means;

image receiving member supplying means for supplying an image receiving member toward said intermediate image receiving means;

first voltage applying means for applying a first voltage to the respective electrode of the respective recording unit to form a first electrical field between the intermediate image receiving means and the respective electrode, the toner particles in the color liquid dispersion being agglomerated near the respective electrode by the first electrical field;

second voltage applying means for applying a second voltage, larger than the first voltage, to the electrode of the recording unit selected in accordance with a plurality of color-separated image signals to form a second electrical field between the intermediate image receiving means and the electrode of the selected recording unit, the agglomerated toner particles near the electrode of the selected recording unit being ejected onto the intermediate image receiving means apart from the insulating carrier by the second electrical field, the agglomerated toner particles ejected from the respective electrode being superimposed on the intermediate image receiving means for forming the color image;

transferring means, contacting said intermediate image receiving means and having a heating member therein, for heating the color image on the intermediate image receiving means and transferring the color image formed on the intermediate image receiving means onto the image receiving member, wherein the color image is transferred onto the image receiving member supplied by the image receiving member supplying means while the image receiving member is pressed to the intermediate image receiving means by the transferring means and a charger for charging the intermediate image receiving means to form the first and second electrical field between said recording units and said intermediate image receiving means, wherein the intermediate image receiving means includes a movable belt comprising a conductive member and an insulating member supported by the conductive member, and wherein the insulating member includes a conductive filler therein.

2. An image recording apparatus, according to claim 1, wherein the filler is selected from carbon, zinc oxide, titanium oxide.

3. An image recording apparatus, according to claim 1, wherein the respective recording unit comprises:

first and second support members in contact with each other;

first, second and third grooves each being formed in an inner surface of the first support member and extending substantially in parallel;

fourth, fifth, and sixth grooves each being formed in an inner surface of the second support member so as to correspond to the first, second, and third grooves;

a guide film sandwiched between the first and second support members, wherein when the first and second support members are in contact with each other, a first color liquid dispersion supply passage is defined by the first and fourth grooves, a second color liquid dispersion supply passage is defined by the second and fifth grooves, and a third color liquid dispersion supply passage is defined by the third and sixth grooves, said first, second and third color liquid dispersion supply passages respectively having an opening facing the intermediate image receiving means respectively and a plurality of electrodes formed on the first, second and third color liquid dispersion supply passages.

4. An image recording apparatus, according to claim 3, wherein the respective recording unit further comprises:

a first partition wall formed between openings of the first and second color liquid dispersion supply passages; and a second partition wall formed between openings of the second and third color liquid dispersion supply passages.

5. An image recording apparatus comprising:

image forming means for forming a color image, said image forming means including a plurality of recording units each recording unit respectively including an electrode and a color liquid dispersion different from the remaining units, each color liquid dispersion being made by dispersing charged toner particles into an insulating carrier;

intermediate image receiving means, movable in a predetermined direction and facing said plurality of recording units for receiving the color image formed by said image forming means, said plurality of recording units being arranged in parallel along said predetermined direction of the intermediate receiving means;

image receiving member supplying means for supplying an image receiving member toward the intermediate image receiving means;

first voltage applying means for applying a first voltage to the respective electrode of the respective recording unit to form a first electrical field between the intermediate image receiving means and the respective electrode, the toner particles in the color liquid dispersion being agglomerated near the respective electrode by the first electrical field;

second voltage applying means for applying a second voltage, which is larger than the first voltage, to the electrode of the recording unit selected in accordance with a plurality of color-separated image signals to form a second electrical field between the intermediate image receiving means and the electrode of the selected recording unit, the agglomerated toner particles near the electrode of the selected recording unit being ejected onto the intermediate image receiving means apart from the insulating carrier by the second electrical field, the agglomerated toner particles ejected from the respective electrode being superimposed on the intermediate image receiving means for forming the color image;

transferring means, contacting said intermediate image receiving means; for transferring the color image on the intermediate image receiving means onto the image receiving member;

third voltage applying means for applying to the transferring means a third voltage to transfer the color image, wherein the color image is transferred onto the image receiving member supplied by the image receiving member supplying means while the image receiving member is pressed to the intermediate image receiving means by the transferring means; and a charger for charging the intermediate image receiving means to form the first and second electrical field between the recording units and the intermediate image receiving means, wherein the intermediate image receiving means includes a movable belt comprising a conductive member and an insulating member supported by the conductive member and wherein the insulating member includes a conductive filler therein.

6. An image recording apparatus, according to claim 5, wherein the filler is selected from carbon, zinc oxide, titanium oxide.

7. An image recording apparatus, according to claim 6, wherein the respective recording unit comprises:

first and second support members in contact with each other, first, second and third grooves each being formed in an inner surface of the first support member and extending substantially in parallel;

fourth, fifth, and sixth grooves each being formed in an inner surface of the second support member so as to correspond to the first, second, and third grooves;

a guide film sandwiched between the first and second support members, wherein when the first and second support members are in contact with each other, a first color liquid dispersion supply passage is defined by the first and fourth grooves, a second color liquid dispersion supply passage is defined by the second and fifth grooves, and a third color liquid dispersion supply passage is defined by the third and sixth grooves, said first, second and third color liquid dispersion supply passages, respectively, having an opening facing the intermediate image receiving means; and a plurality of electrodes formed on the first, second and third color liquid dispersion supply passages.

8. An image recording apparatus, according to claim 7, wherein the respective recording unit further comprises a first partition wall formed between openings of the first and second color liquid dispersion supply passages; and a second partition wall formed between openings of the second and third color liquid dispersion supply passages.

* * * * *